US010230169B2

(12) United States Patent
Daniel

(10) Patent No.: US 10,230,169 B2
(45) Date of Patent: Mar. 12, 2019

(54) META-ANTENNA

(71) Applicant: Palo Alto Research Center Incorporated, Palo Alto, CA (US)

(72) Inventor: George W. Daniel, Mountain View, CA (US)

(73) Assignee: PALO ALTO RESEARCH CENTER INCORPORATED, Palo Alto, CA (US)

( * ) Notice: Subject to any disclaimer, the term of this patent is extended or adjusted under 35 U.S.C. 154(b) by 48 days.

(21) Appl. No.: 15/669,725

(22) Filed: Aug. 4, 2017

(65) Prior Publication Data

US 2019/0044247 A1 Feb. 7, 2019

(51) Int. Cl.

| | |
|---|---|
| ***H01Q 1/38*** | (2006.01) |
| ***H01Q 5/00*** | (2015.01) |
| ***H01Q 9/04*** | (2006.01) |
| ***H01Q 19/00*** | (2006.01) |
| *H01Q 7/00* | (2006.01) |

(52) U.S. Cl.
CPC ..... *H01Q 19/005* (2013.01); *H01Q 9/0407* (2013.01); *H01Q 7/00* (2013.01)

(58) Field of Classification Search
CPC ..... H01Q 19/005; H01Q 9/0407; H01Q 7/00
USPC ..... 343/700 MS, 904, 702
See application file for complete search history.

(56) References Cited

U.S. PATENT DOCUMENTS

| | | | | |
|---|---|---|---|---|
| 7,009,564 | B2 * | 3/2006 | Ryken | H01Q 1/40 343/700 MS |
| 8,618,990 | B2 * | 12/2013 | Somero | H01Q 1/48 343/702 |
| 2004/0252061 | A1 * | 12/2004 | Vance | H01Q 1/243 343/702 |
| 2011/0109525 | A1 * | 5/2011 | Takemura | H01Q 9/42 343/904 |
| 2016/0359240 | A1 * | 12/2016 | Cho | H01Q 13/08 |

* cited by examiner

*Primary Examiner* — Jean B Jeanglaude
(74) *Attorney, Agent, or Firm* — Shun Yao; Park, Vaughan, Fleming & Dowler LLP

(57) ABSTRACT

A small, inexpensive, printable meta-antenna system is described. In addition to being smaller than existing antennas, the meta-antenna improves over them by being omnidirectional, and having a broader gain function and better efficiency. Some embodiments include a main element with a shape of a loop and two parasitic elements enclosed by the main element. Each parasitic element may be shaped as a loop with an opening. The openings of the two parasitic elements may be positioned adjacent to opposing sides of the main element, respectively.

18 Claims, 8 Drawing Sheets

META-ANTENNA

STATEMENT OF GOVERNMENT-FUNDED RESEARCH

This invention was made with U.S. government support under Contract No. DE-AR0000542 awarded by the Advanced Research Projects Agency in the Department of Energy (ARPA-E). The U.S. government has certain rights in this invention.

BACKGROUND

Field

The present disclosure relates to antenna designs. More specifically, this disclosure relates to a small, inexpensive, omni-directional, printable meta-antenna with a broad impedance bandwidth and near constant gain.

Related Art

Wireless communication is a key component of mobile computing technology. Network applications such as web browsing, streaming, and other forms of data consumption are increasingly moving to mobile devices. In addition, the continued growth of Internet of Things (IoT) further stimulates the demand for more advanced wireless communication technologies.

Among various wireless communication technologies, antenna design remains a critically important part. Many antennas used in mobile devices are based on a dipole or planar inverted-F antenna (PIFA) design, which suffers from a number of drawbacks. In general, especially in digital communication based on quadrature amplitude modulation (QAM) where amplitude is a key part of the signal, a dipole antenna often requires the dimension of the antenna to be approximately half the wavelength corresponding to the transmission frequency. Such antennas can be too large to be used in many applications without performance compromises. Moreover, dipole-based antennas typically have a narrow impedance bandwidth, for instance a bandwidth of approximately 10% of the target frequency. As a result, these antennas are not easily adaptable for wide-bandwidth applications and often suffer performance degradation when used in diverse environments. In addition, conventional antennas might not have the ideal directionality for the intended use.

SUMMARY

One embodiment described herein provides an antenna. This antenna comprises a main element with a shape of a loop and two parasitic elements enclosed by the main element. Each parasitic element is shaped as a loop with an opening. The openings of the two parasitic elements are positioned adjacent to opposing sides of the main element, respectively.

In a variation on this embodiment, the main element has a substantially rectangular shape.

In a variation on this embodiment, a long edge of the main element is substantially equal to one-quarter of a desired transmission wavelength.

In a variation on this embodiment, a short edge of the main element is substantially equal to one-eighth of a desired transmission wavelength.

In a variation on this embodiment, the main element comprises an opening that serves as a feed point. The opening of the main element is positioned approximately at a midpoint of a long edge of the main element.

In a variation on this embodiment, the antenna has a nominal impedance of approximately 100 Ohms.

In a variation on this embodiment, the main element and parasitic elements comprise conductive ink printed on a surface.

In a variation on this embodiment, the main element and parasitic elements comprise metal traces deposited on a substrate.

In a variation on this embodiment, the main element is configured to be driven directly by a differential RF signal.

BRIEF DESCRIPTION OF THE FIGURES

In the figures, like reference numerals refer to the same figure elements.

DETAILED DESCRIPTION

Figure 1:
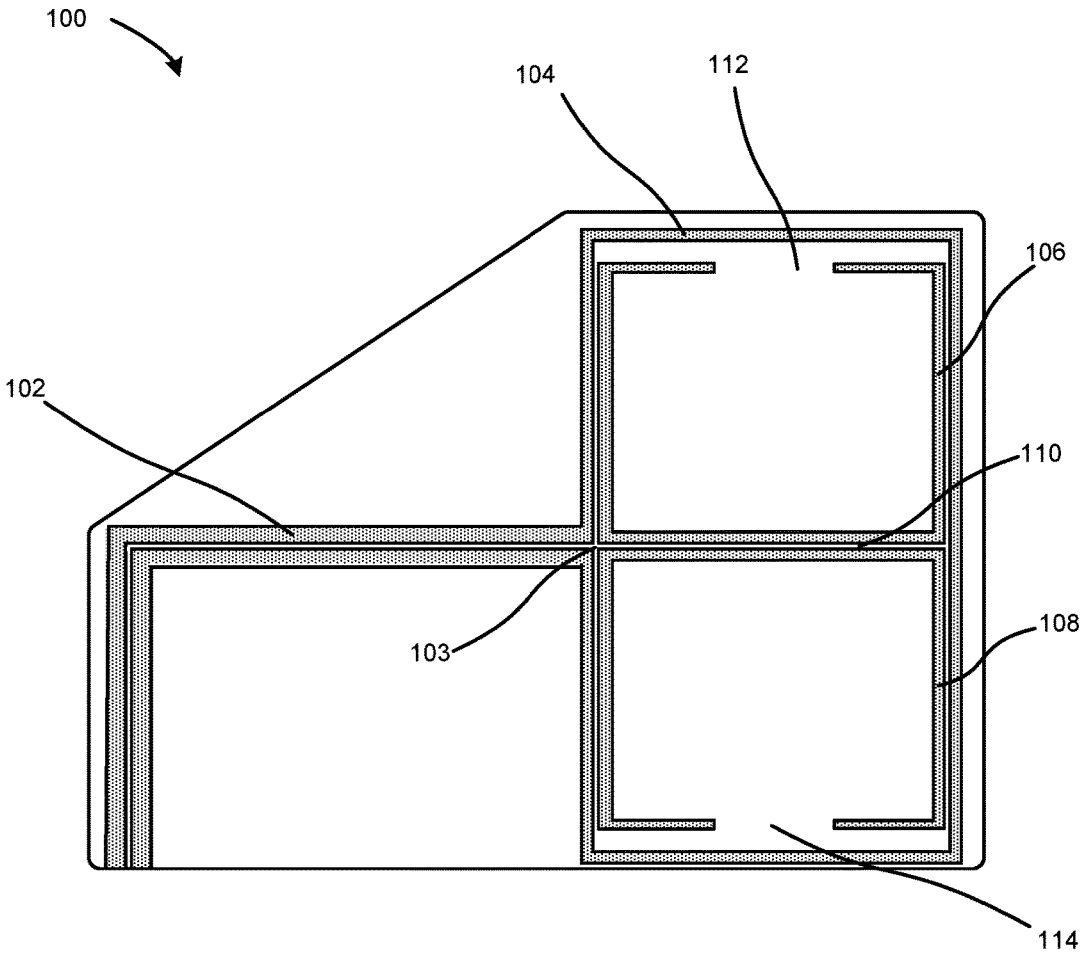
FIG. 1 shows an exemplary geometry of a meta-antenna system, according to one embodiment of the present invention.

The following description is presented to enable any person skilled in the art to make and use the embodiments, and is provided in the context of a particular application and its requirements. Various modifications to the disclosed embodiments will be readily apparent to those skilled in the art, and the general principles defined herein may be applied to other embodiments and applications without departing from the spirit and scope of the present disclosure. Thus, the present invention is not limited to the embodiments shown, but is to be accorded the widest scope consistent with the principles and features disclosed herein.

Overview

Embodiments of the present invention solve the problems associated with the large size, narrow bandwidth, and directionality of dipole-based antennas by providing a small and inexpensive antenna system, which is printable on a substrate with conductive ink. In addition to being smaller than conventional antennas, the disclosed antenna system can be omni-directional, with a broader gain window and better efficiency, and therefore robust in different operating environments. The disclosed antenna system can include a main antenna element and a resonator inductively coupled to the main antenna element. The main antenna element may include a conductive circuit (which can be a trace) on a plane. The resonator may include two non-intersecting resonant elements on the same plane and enclosed within the conductive circuit of the main antenna element. Because the present inventive antenna system makes use of principles similar to those used in metamaterials, this antenna system can also be referred to as a "meta-antenna."

The present meta-antenna system can achieve wider bandwidth, be fed directly with a differential RF signal, and facilitate a significantly reduced size by including a two-element inductively coupled resonator. Specifically, existing dipole or loop antennas typically have a height of approximately half the wavelength of the resonant frequency (assuming the antenna is positioned vertically). By contrast, the disclosed meta-antenna system can have a height of approximately one-quarter the resonant wavelength. Thus, the meta-antenna is approximately half the size of a comparable dipole antenna.

Moreover, the disclosed antenna system can provide a flat gain profile over a much larger bandwidth (about 40% of the resonant frequency). The system can operate in diverse environments and can tolerate a wider impedance variation. In addition, this meta-antenna system can be fed directly with a differential RF signal, which obviates the need of a balun. As a result, fewer components are needed, which reduces production costs.

The small size, versatility, and low cost of the disclosed meta-antenna make it excellent for mobile applications, especially IoT. In particular, the meta-antenna system is well-suited for multiple-input and multiple-output (MIMO) devices. For example, for a Wi-Fi device such as a router, the meta-antenna makes it technically and economically viable to include multiple high-performance antennas within a small router, providing multiple wireless channels. The meta-antenna can be manufactured using a conventional process (e.g., by etching Cu deposited on a film or substrate), which can produce a flexible circuit to which components can be soldered. The meta-antenna can also be printed on a substrate (such as polyethylene naphthalate or PEN), either as part of a circuit, or as a separate unit that can be attached to other devices.

These desirable properties are due to the meta-antenna's unique design. As will be described below, the disclosed antenna system features a two-element resonator mechanism, wherein two parasitic elements interact with a main antenna element and with each other. This multi-element resonant system can behave as a family of closely coupled arrays.

Design of Meta-Antenna System

FIG. 1 shows an exemplary geometry of a meta-antenna system, according to one embodiment of the present invention. In this example, meta-antenna system 100 includes a main antenna element 104 and two parasitic elements 106 and 108. Main antenna element 104 can be a loop antenna which is fed a differential RF signal by feeding circuit 102. Parasitic elements 106 and 108 are positioned side by side in the same plane as, and enclosed by, main antenna element 104. Parasitic elements 106 and 108 can be identically or substantially identically shaped. In one embodiment, each of parasitic elements 106 and 108 is shaped like a loop with openings 112 and 114, respectively (e.g., in a shape similar to the letter "C"). Furthermore, openings 112 and 114 can be positioned on opposite sides within main antenna element 104 (i.e., near the two ends along the longer side of main antenna element 104). Parasitic elements 106 and 108 are insulated from each other and from main antenna element 104, and are positioned sufficiently close to main antenna element 104 such that an alternating current can be induced therein during operation.

In one embodiment, main antenna element 104 can have a rectangular or substantially rectangular shape, with its longer edge substantially equal to (e.g., within ±10% of) or slightly longer than (e.g., no more than 110% of) a quarter of the desired transmission wavelength, and its shorter edge substantially equal to (e.g., within ±10% of), slightly longer than (e.g., no more than 110% of), or slightly shorter than (e.g., no less than 90% of) an eighth of the desired wavelength. For many applications, vertically polarized radiation is desirable (as most transmission and receiving antennas are positioned vertically). Assuming that the meta-antenna is positioned vertically (for example, along the length of a typical smart phone held vertically), the height of the meta-antenna is approximately a quarter of the desired transmission wavelength, and the width is approximately an eighth of this wavelength. By contrast, a conventional vertically positioned dipole antenna would require half the wavelength in the vertical direction. The space savings of the meta-antenna can be significant.

Furthermore, assuming that meta-antenna 100 is positioned vertically for most applications, parasitic elements 106 and 108 can both be horizontally oriented, rectangular conductive paths. The bottom edge of parasitic element 106 can be positioned slightly above horizontal mid plane 110 of main antenna element 104, and parasitic element 108 can be positioned slightly below mid plane 110. Both parasitic elements 106 and 108 can be completely enclosed by main antenna element 104. Parasitic element 106 can have opening 112 in the middle of its top side; similarly, parasitic element 108 can have opening 114 of approximately the same size on the bottom side, such that parasitic elements 106 and 108 are mirror images about mid plane 110 of main antenna element 104.

In addition, an opening 103 is positioned near the center of one of the longer edges of main antenna element 104. Opening 103 can serve as a differential feed point and be coupled to a feeding circuit 102, which can feed a differential RF signal to meta-antenna 103. In one embodiment, opening 103 produces a 100 Ohm nominal impedance in the meta-antenna. This nominal impedance can be adjusted (e.g., to 75 Ohms or 300 Ohms), to suit different applications, by modifying the geometry of meta-antenna 100 (e.g., changing the size of opening 103, and/or changing the length/width of meta-antenna 100).

In some embodiments, the size of openings 112 and 114, and the space separating parasitic elements 106 and 108 from main element 104, can be varied. Such structural variation allows the meta-antenna to have different impedances. In particular, the meta-antenna can be optimized for resonant frequency, bandwidth, and/or directionality for a given application.

If meta-antenna 100 is implemented using conductive traces (e.g., conductive material etched or printed on a film), the width of such traces can take various values. For example, the width of the conductive trace for both the main antenna element 104 and parasitic elements 106 and 108 can range from 0.1 mm to 10 mm. Other ranges are also possible.

During operation, opening 103 in main antenna element 104 serves as an entry for a differential RF signal, wherein half the input power is fed at zero phase angle into one branch of opening 103 and the other half of the input power is fed at 180° phase angle to the other branch of opening 103. One of the signal currents flows outward into one side of the loop of main antenna element 104, while the other signal current flows inward from the other side of the loop. The conductive path of main antenna element 104 is in close proximity to the side paths of parasitic elements 106 and 108, thereby inducing current flow in both. This induced current results in resonance in both elements 106 and 108, which in turn produces a highly vertically polarized, omni-directional radiation in a toroidal pattern with a gain exceeding that of a dipole of twice the length.

Figure 2A:
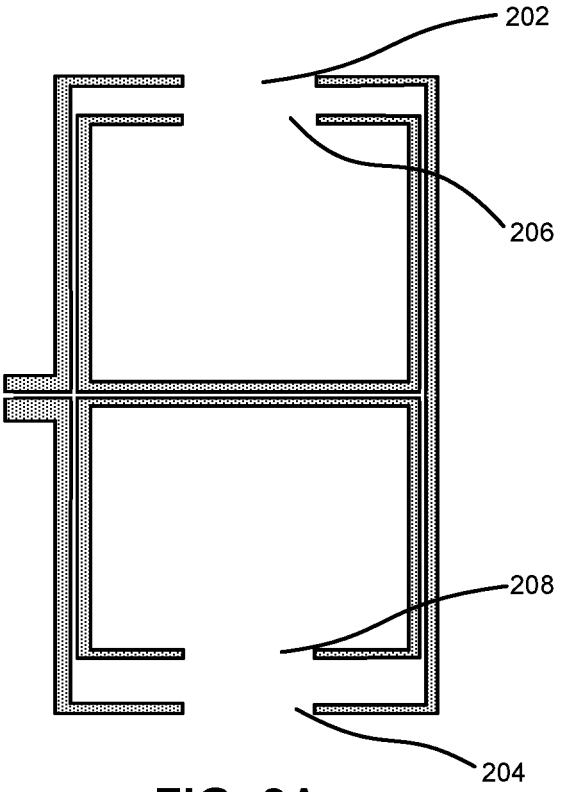
FIG. 2A illustrates another exemplary geometry of the resonant meta-antenna system, according to one embodiment of the present invention.

The meta-antenna system is not limited to the geometry shown in FIG. 1, and can have a configuration that includes a main antenna element and a resonator inductively coupled to the main antenna element. FIG. 2A illustrates another exemplary geometry of the resonant meta-antenna system, according to one embodiment of the present invention. In some embodiments, the main antenna element can contain breaks 202 and 204, which may line up with the breaks 112 and 114 in the conductive resonator. Therefore, the main antenna element need not form a closed circuit, or can be a line or dipole antenna element.

Figure 2B:
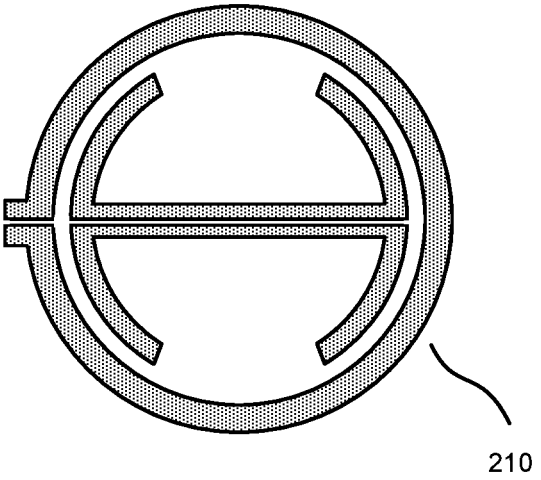
FIG. 2B illustrates another exemplary geometry of the resonant meta-antenna system, according to one embodiment of the present invention.

The shape of the meta-antenna, including the main antenna element and conductive resonator, need not be limited to rectangular. FIG. 2B illustrates another exemplary geometry of the resonant meta-antenna system, according to one embodiment of the present invention. In this example, the main element of the meta-antenna can be a curve or circle 210, square, or another shape, or can be three-dimensional. In some embodiments, the resonator is in close enough proximity to be inductively coupled to main element 104, but is not enclosed by element 104. For example, in some embodiments where the main element is a dipole rather than rectangular, the resonator may comprise several elements arranged around the dipole.

Operation of the Meta-Antenna System

Figure 3:
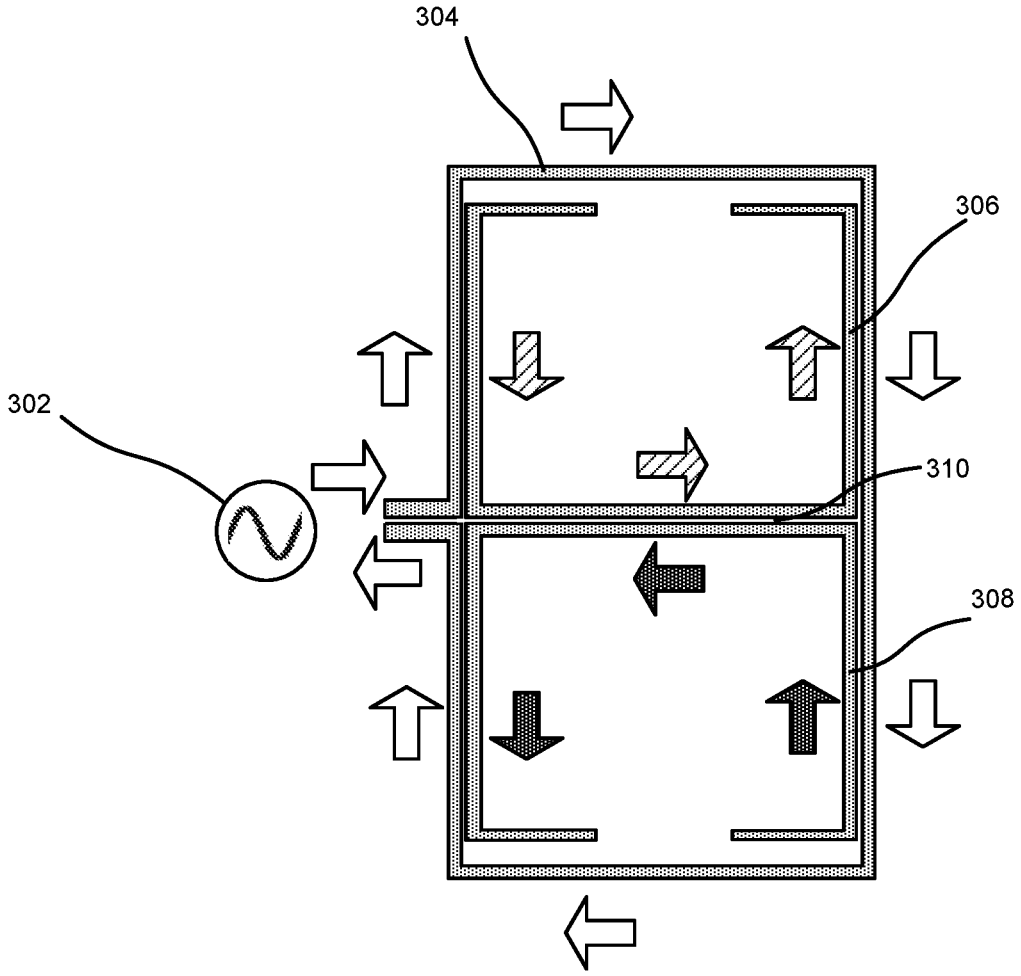
FIG. 3 illustrates instantaneous current flows in a meta-antenna system, according to one embodiment of the present invention.

FIG. 3 illustrates instantaneous current flows in a meta-antenna system, according to one embodiment of the present invention. As shown, a power source 302 may drive the meta-antenna at the desired carrier frequency. As shown in this example, the current from power source 302 may feed into main antenna element 304. The current may proceed around main element 304 clockwise or counterclockwise, depending on the instantaneous polarity of the driving signal. Because parasitic elements 306 and 308 are in close proximity to main element 304, the AC current in main element 304 can induce instantaneous currents in parasitic elements 306 and 308. Based on Lenz's law, the induced currents would oppose the magnetic flux change caused by the current in main element 304. In particular, the two currents in the two parasitic elements may travel in the same sense (i.e., both clockwise or counterclockwise), which is determined by the change of the current in main element 304.

As in a conventional dipole or loop antenna, the current in main element 304 can form a standing wave. This standing wave resonates at a wavelength corresponding to the perimeter of main element 304, as discussed previously. As a result, the induced currents in parasitic elements 306 and 308 also form standing waves. Parasitic elements 306 and 308 thereby behave like oscillatory circuit elements, storing electrical energy within the vicinity of the meta-antenna's main loop 304 and emitting the stored energy as electromagnetic radiation. These resonant mechanisms reinforce the signal transmission as in a closely coupled array, providing the meta-antenna with greater efficiency and better, broader gain with a small size. In addition, in some embodiments, the system can operate without a separate balun, in contrast with a conventional dipole antenna. This is because the main antenna element forms a closed circuit loop, so that the equivalent of a balun is included within the antenna.

Characteristics and Performance of the Meta-Antenna

Figure 4A:
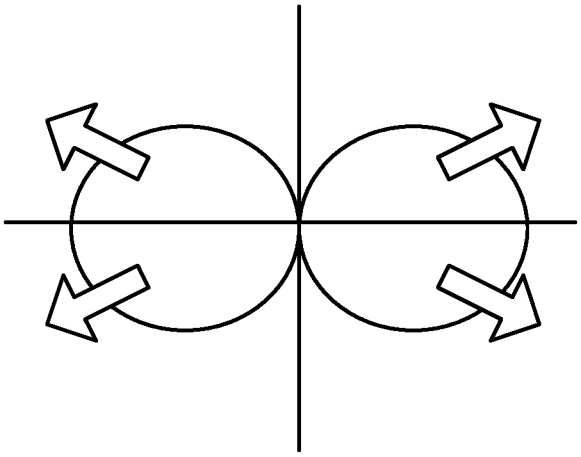
FIG. 4A presents a two-dimensional diagram illustrating an exemplary meta-antenna radiation pattern, according to one embodiment of the present invention.
Figure 4B:
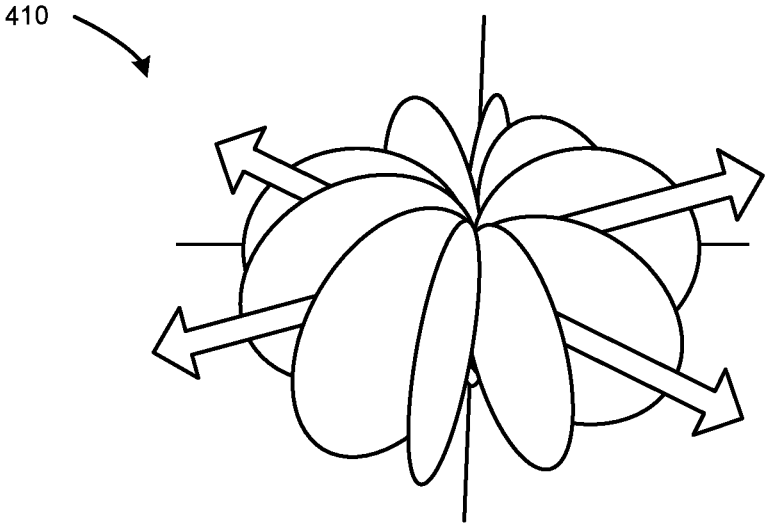
FIG. 4B presents a three-dimensional perspective diagram illustrating an exemplary meta-antenna radiation pattern, according to one embodiment of the present invention.

FIG. 4A presents a two-dimensional diagram illustrating an exemplary meta-antenna radiation pattern, according to one embodiment of the present invention. As shown, the meta-antenna may emit vertically polarized, omni-directional radiation in a toroidal pattern. FIG. 4B presents a three-dimensional perspective diagram illustrating an exemplary meta-antenna radiation pattern, according to one embodiment of the present invention. As shown, toroidal radiation pattern 410 may have cylindrical symmetry about a vertical axis passing through the meta-antenna (i.e., an axis parallel to the height of the main element).

This symmetry results in highly isotropic or omni-directional operability of the system, for both transmission and reception. Moreover, the meta-antenna can operate in close proximity of a ground plane, and still maintain this omni-directional pattern. This isotropy is another advantage of the disclosed system, in contrast with existing systems (e.g., typical antennas for cellular phones) that do not provide isotropic radiation pattern, and thus may provide sub-optimal gain in certain directions.

Figure 5:
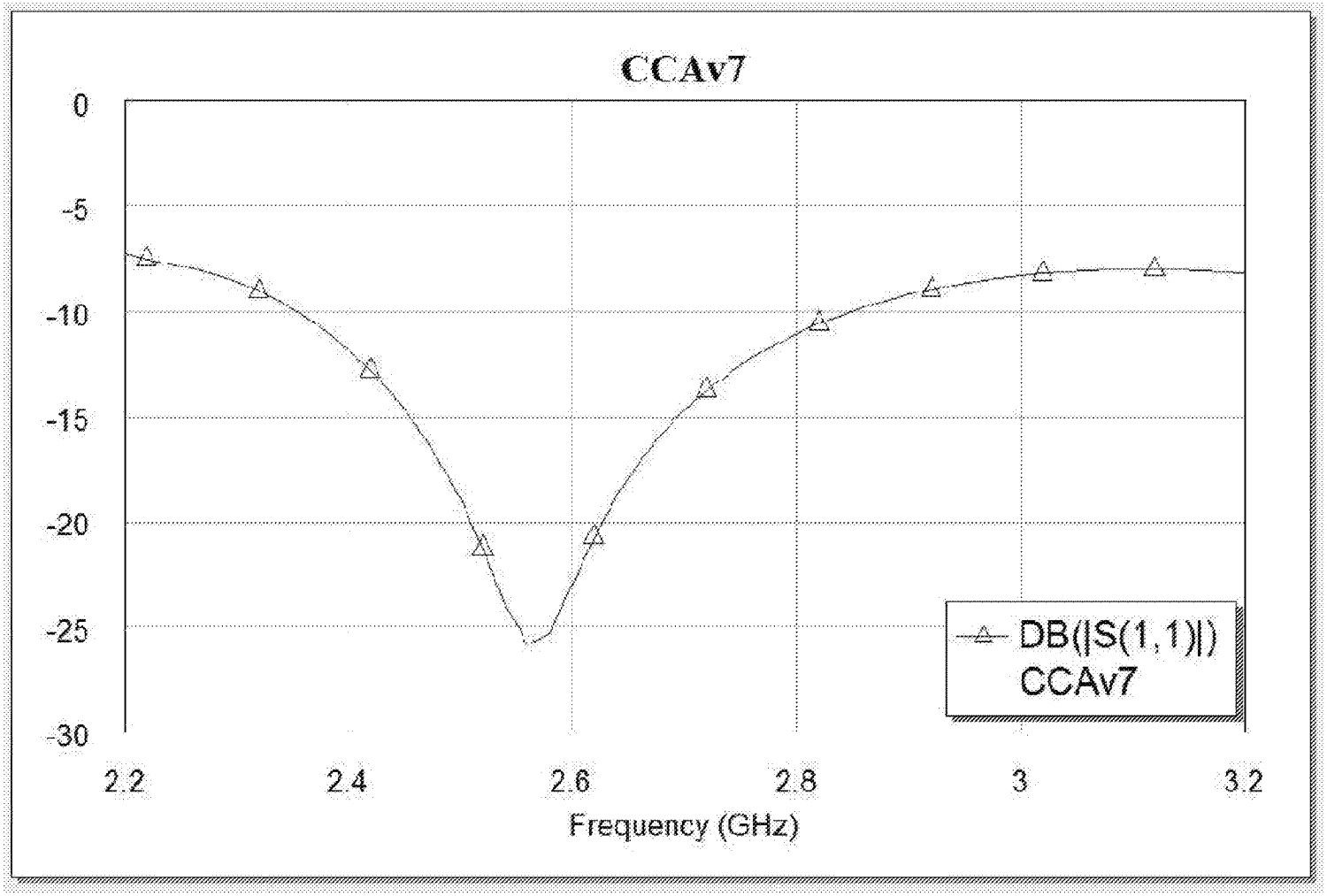
FIG. 5 illustrates an exemplary return loss spectrum covering several bands, according to one embodiment of the present invention.

The disclosed system has a flat, broad gain function, enabling it to operate over a bandwidth range of up to approximately 40% of the peak frequency (that is, the frequency at which gain is maximized). The flat gain is attributable to both the system's impedance bandwidth, and its radiation pattern bandwidth, being very wide. In digital communication systems, a more flat and constant gain profile over a broader frequency range typically results in better bit error rate (BER) performance. FIG. 5 illustrates an exemplary return loss spectrum covering several bands, according to one embodiment of the present invention. In this example, the impedance bandwidth has a width of approximately 600 MHz for a return loss function peaked at approximately 2.6 GHz. Moreover, the peak return loss is below −25 dB, corresponding to only about 0.3% reflection. The disclosed meta-antenna's wide impedance bandwidth can be used for dual band operation.

Figure 6A:
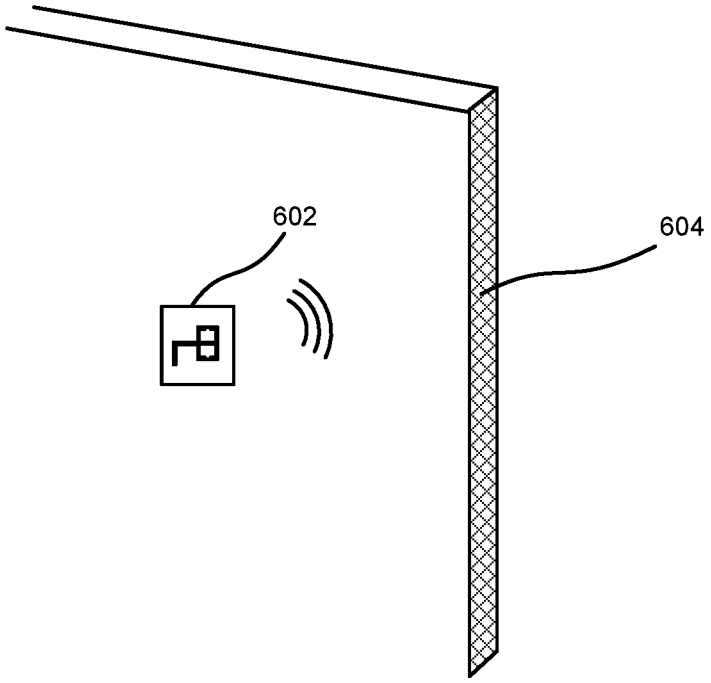
FIG. 6A illustrates operation of the meta-antenna system while mounted on a wall, according to one embodiment of the present invention.

Such a flat gain function allows the antenna to cope effectively with diverse environments having different impedances, e.g. for operation in proximity of a ground plane or a printed circuit board, or mounted on different types or thicknesses of wall. FIG. 6A illustrates operation of the meta-antenna system while mounted on a wall, according to one embodiment of the present invention. As shown, meta-antenna 602 may be part of a device, for example a smart appliance, mounted on wall 604, which is made of moderately thick drywall.

Figure 6B:
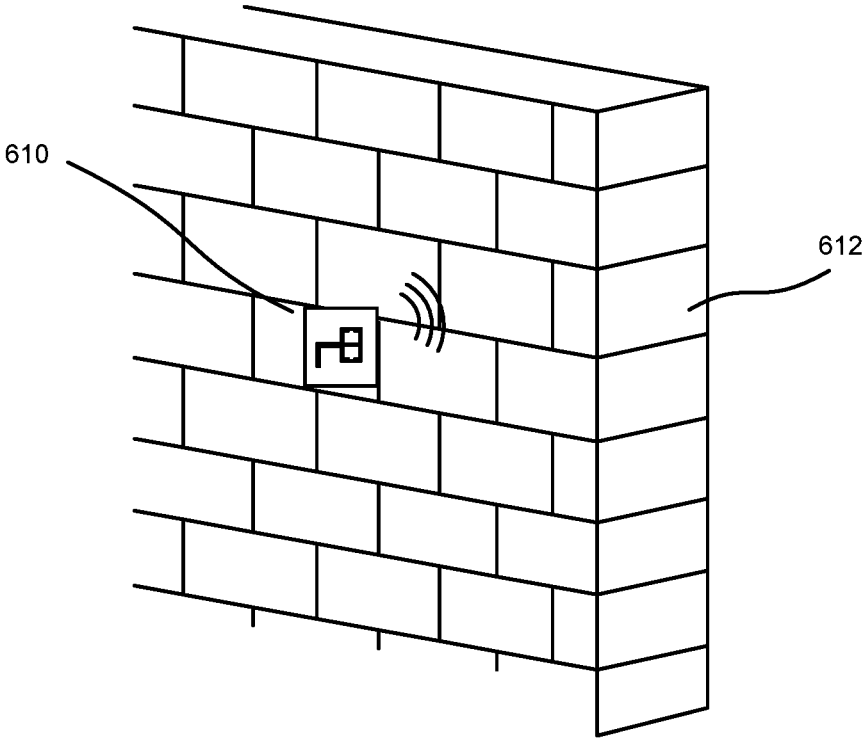
FIG. 6B illustrates robustness of the meta-antenna system while operating in the environment of walls of differing thickness and materials, according to one embodiment of the present invention.

FIG. 6B illustrates robustness of the meta-antenna system while operating in the environment of walls of differing thickness and materials, according to one embodiment of the present invention. As shown, meta-antenna 610 may operate mounted on, or in proximity to, wall 612, which may be considerably thicker than wall 604, and may be made of a denser material such as cinderblock. As a result of the meta-antenna's broad gain bandwidth, the system can operate effectively in the vicinity of either wall 604 or 612.

Exemplary Applications

Figure 7A:
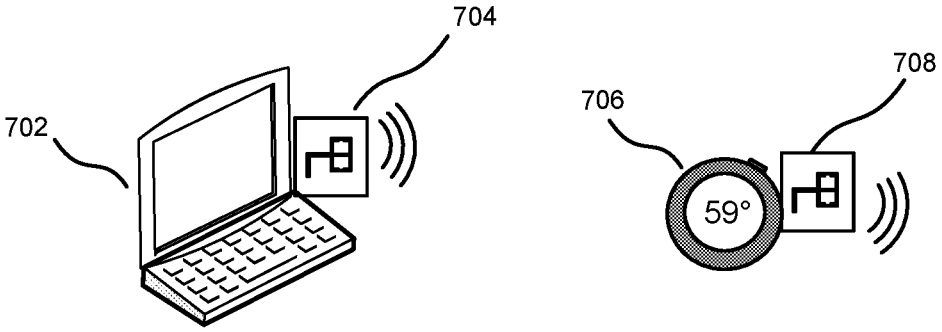
FIG. 7A illustrates exemplary devices utilizing the meta-antenna system, according to one embodiment of the present invention.

FIG. 7A illustrates exemplary devices utilizing the resonant meta-antenna system, according to one embodiment of the present invention. For example, personal computing device 702 may include meta-antenna system 704 to communicate with a Wi-Fi network or with other devices. Likewise, smart appliance or IoT device 706 may use meta-antenna 708 to communicate with a network or other devices. A user can use laptop 702 to control smart thermostat 706 by either direct communication via antennas 704 and 708, or through a network.

Figure 7B:
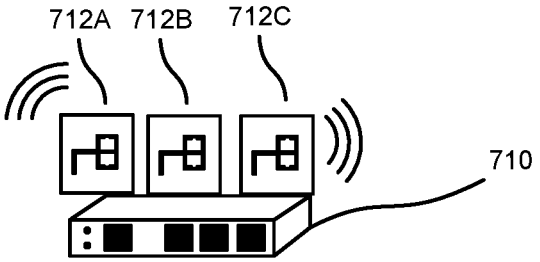
FIG. 7B illustrates a multiple-input and multiple-output (MIMO) system utilizing the meta-antenna, according to one embodiment of the present invention.

FIG. 7B illustrates a multiple-input and multiple-output (MIMO) system utilizing the meta-antenna, according to one embodiment of the present invention. In this example, Wi-Fi router or MIMO device 710 may contain meta-antennas 712A, 712B, and 712C to transmit multiple data streams using multipath propagation. The disclosed meta-antennas are especially well-suited for MIMO applications because their small sizes allow multiple antennas to fit easily into a device such as router 710, providing multiple communication channels.

Figure 7C:
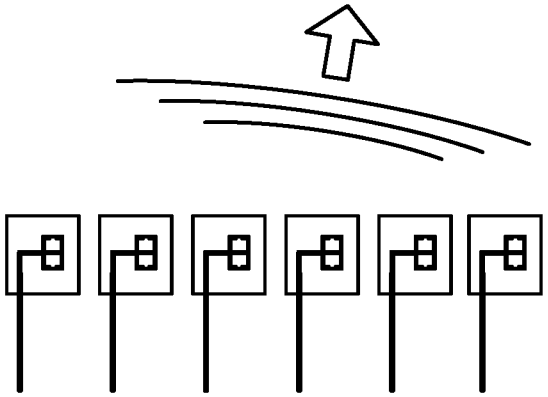
FIG. 7C illustrates using meta-antennas within a phased array system, according to one embodiment of the present invention.

In some embodiments, the disclosed meta-antenna system can be used in a phased array for applications that require strong directionality, such as a radar. Using the meta-antenna in a phased array involves sending a signal to a set of meta-antennas arranged in a predetermined pattern, with phase shifters introducing a phase delay between the meta-antennas. FIG. 7C illustrates using meta-antennas within a phased array system, according to one embodiment of the present invention. In this example, the phased array includes six meta-antennas and uses constructive and destructive interference to steer the signal transmission in a desired direction. The meta-antenna's small form factor allows a phased array to fit into compact mobile devices. Moreover, the system's wide operational bandwidth and ability to operate in close proximity with other elements are well suited for phased arrays. In some embodiments, the system can use a proximity aperture feeding point instead of a direct feeding point to drive the meta-antenna, which can further enhance the system's performance.

Figure 8:
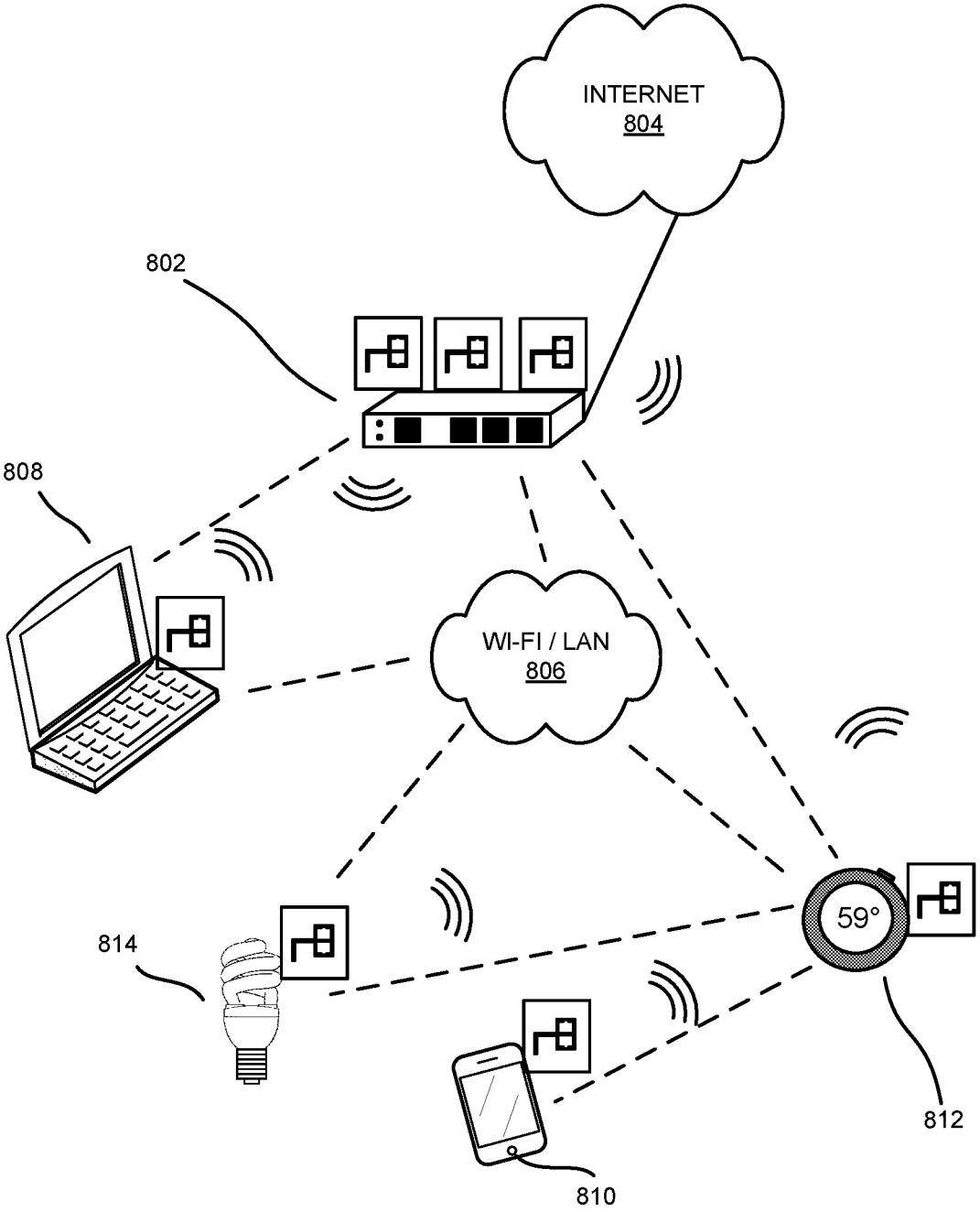
FIG. 8 illustrates operation of the meta-antenna system within an exemplary network, according to one embodiment of the present invention.

FIG. 8 illustrates operation of the meta-antenna system within an exemplary network, according to one embodiment of the present invention. As shown, wireless router 802 may couple to Internet 804 and to network 806, which may include Wi-Fi, local-area network (LAN), cellular, wide-area network (WAN), Radio-frequency identification (RFID), or other communication technologies. Wireless router 802 may include multiple meta-antennas for MIMO transmission, as shown in FIG. 7B. A plurality of devices may participate in network 804, such as computer 808 and mobile device 810, as well as IoT devices or smart appliances such as smart thermostat 812, and smart lighting system 814.

These devices can communicate with router 802 or via network 806, or can communicate with each other directly using wireless signals transmitted and received by the disclosed meta-antenna system (e.g., machine-to-machine (M2M) or other communications protocols). For example, mobile device 810 can send commands from a user to smart appliance 812, e.g. to adjust the thermostat's settings. Likewise, smart lighting system 814 and smart thermostat 812 can communicate, for example to execute a pre-existing rule to turn on heating and cooling systems automatically when a user enters the building and turns on a light. The meta-antenna's broad bandwidth enables it to cope particularly effectively with diverse environments, such as walls of differing thicknesses and materials. Hence, lighting system 814 and thermostat 812, which may be ceiling- or wall-mounted, can nonetheless communicate with each other reliably and efficiently according to the disclosed system and methods.

The methods and systems described herein can also be integrated into hardware modules or apparatus. These modules or apparatus may include, but are not limited to, an application-specific integrated circuit (ASIC) chip, a field-programmable gate array (FPGA), a system on a chip (SoC), and/or other circuit devices now known or later developed. When the hardware modules or apparatus are activated, they perform the circuit functions included within them.

The foregoing descriptions of various embodiments have been presented only for purposes of illustration and description. They are not intended to be exhaustive or to limit the present invention to the forms disclosed. Accordingly, many modifications and variations will be apparent to practitioners skilled in the art. Additionally, the above disclosure is not intended to limit the present invention.

What is claimed is:

1. An antenna comprising:

a main element with a shape of a loop; and two parasitic elements enclosed by the main element, wherein each parasitic element is shaped as a loop with an opening, and wherein the openings of the two parasitic elements are positioned adjacent to opposing sides of the main element, respectively.

2. The antenna of claim 1, wherein the main element has a substantially rectangular shape.

3. The antenna of claim 2, wherein a long edge of the main element is substantially equal to one-quarter of a desired transmission wavelength.

4. The antenna of claim 2, wherein a short edge of the main element is substantially equal to one-eighth of a desired transmission wavelength.

5. The antenna of claim 2:

wherein the main element comprises an opening that serves as a feed point; and wherein the opening of the main element is positioned approximately at a midpoint of a long edge of the main element.

6. The resonant antenna of claim 1, wherein the antenna has a nominal impedance of approximately 100 Ohms.

7. The resonant antenna of claim 1, wherein the main element and parasitic elements comprise conductive ink printed on a surface.

8. The resonant antenna of claim 1, wherein the main element and parasitic elements comprise metal traces deposited on a substrate.

9. The resonant antenna of claim 1, wherein the main element is configured to be driven directly by a differential RF signal.

10. An antenna system comprising a balanced transmission line coupled to an antenna, wherein the antenna comprises:

a main element with a shape of a loop; and two parasitic elements enclosed by the main element, wherein each parasitic element is shaped as a loop with an opening, and wherein the openings of the two parasitic elements are positioned adjacent to opposing sides of the main element, respectively.

11. The antenna system of claim 10, wherein the main element has a substantially rectangular shape.

12. The antenna system of claim 11, wherein a long edge of the main element is substantially equal to one-quarter of a desired transmission wavelength.

13. The antenna system of claim 11, wherein a short edge of the main element is substantially equal to one-eighth of a desired transmission wavelength.

14. The antenna system of claim 11:

wherein the main element comprises an opening that serves as a feed point; and wherein the opening of the main element is positioned approximately at a midpoint of a long edge of the main element.

15. The antenna system of claim 10, wherein the antenna has a nominal impedance of approximately 100 Ohms.

16. The antenna system of claim 10, wherein the main element and parasitic elements comprise conductive ink printed on a surface.

17. The antenna system of claim 10, wherein the main element and parasitic elements comprise metal traces deposited on a substrate.

18. The antenna system of claim 8, wherein the main element is configured to be driven directly by a differential RF signal.

* * * * *